United States Patent [19]

Franklin

[11] 3,970,195

[45] July 20, 1976

[54] CROCHET NEEDLE STORAGE AND DISPENSING DEVICE

[76] Inventor: Veatrice Franklin, 1927 W. Harle, Anaheim, Calif. 92804

[22] Filed: Aug. 4, 1975

[21] Appl. No.: 601,414

[52] U.S. Cl. ..... 206/380; 206/443; 206/459; 221/5; 221/88; 221/190; 221/261

[51] Int. Cl.[2] ..... B65D 85/24

[58] Field of Search ..... 206/379–380, 206/443, 459; 221/5, 79, 81, 87–89, 190–192, 256, 261, 311; 223/106–108, 109 R

[56] References Cited

UNITED STATES PATENTS

| | | | |
|---|---|---|---|
| 24,070 | 5/1859 | Wheeler | 206/380 |
| 2,398,896 | 4/1946 | Simmons et al. | 206/379 X |
| 2,843,292 | 7/1958 | Baehr | 221/190 |
| 2,844,244 | 7/1958 | Hanson | 206/379 |
| 2,919,796 | 1/1960 | Pressl | 206/379 X |

FOREIGN PATENTS OR APPLICATIONS

| | | | |
|---|---|---|---|
| 138,190 | 8/1950 | Australia | 206/443 |
| 1,153,454 | 3/1958 | France | 206/380 |
| 1,005,408 | 3/1957 | Germany | 206/380 |

*Primary Examiner*—Steven E. Lipman

[57] ABSTRACT

A light weight, portable device for removably storing a number of needles of various transverse cross section but of substantially the same length, which needles have crochet hooks defined on first ends thereof, and the device capable of being used to selectively dispense any desired one of the needles therefrom by a simple manual operation.

6 Claims, 5 Drawing Figures

CROCHET NEEDLE STORAGE AND DISPENSING DEVICE

BACKGROUND OF THE INVENTION

1. Field of the Invention

Crochet Needle Storage and Dispensing Device.

2. Description of the Prior Art

In crocheting it is common practice to employ a number of needles of various sizes. Such needles during the crocheting operation may be easily lost or mislaid.

The primary object of devising the present invention is to supply a light weight portable device in which crochet hook defining needles of various sizes may be stored when not in use, but any one of the needles being readily dispensed from the device for use by a simple manual operation.

Another object of the invention is to maintain a number of crochet hook defining needles in a confined space, but one in which the needles may be readily dispensed, and due to the needles being maintained in the confined space when not in use the probability of them being lost or mislaid is substantially eliminated.

SUMMARY OF THE INVENTION

The invention which is used in storing a number of crochet hook defining needles of various sizes and selectively dispensing any one of these needles, includes a cylindrical housing that has a first end portion and a second opened end. The first end portion includes an inwardly extending tubular member that defines both a longitudinally extending cam surface and a portion of circular transverse cross section. The cam surface is radially aligned with a longitudinal slot in the housing. The tubular member has a first inwardly extending body shoulder defined therein. A needle holding assembly is provided that includes first and second generally circular members and tubular means that extend therebetween. The tubular means includes a second body shoulder intermediately disposed therein. The first generally circular member includes a number of circumferentially spaced resilient clips that removably engage longitudinal sections of the needles adjacent the first ends thereof. The second generally circular member includes a number of circumferentially spaced longitudinally extending sockets that are aligned with the clips and removably engage second ends of the needles. The assembly is disposed within the housing and serves to removably support the needles. The tubular means of the assembly rotatably and slidably engages the portion of the tubular member of circular transverse cross section. A compressed helical spring is provided that at all times tends to move the assembly away from the tubular member. Stop means are provided that extend between the first and second body shoulders and allow the spring to move the assembly and needles to a first position in the housing where the assembly may be rotated without the needles contacting the cam surface.

A cam is provided that closes the second end of the housing and is rigidly secured to the assembly. The cap has a plurality of indicia thereon, each of which indicia when longitudinally aligned with the slot visually indicate the particular one of the needles that is in a dispensable condition in the housing. The dispensable needle is dispensed through the slot when the assembly and cap are manually forced toward the first end of the housing to bring the hook defining end of the dispensable needle into sliding pressure contact with the cam surface. After the needle is dispensed the spring means automatically return the assembly to the first position after the cap and assembly cease having a manual force exerted thereon.

DESCRIPTION OF THE PREFERRED EMBODIMENT

Figure 1:
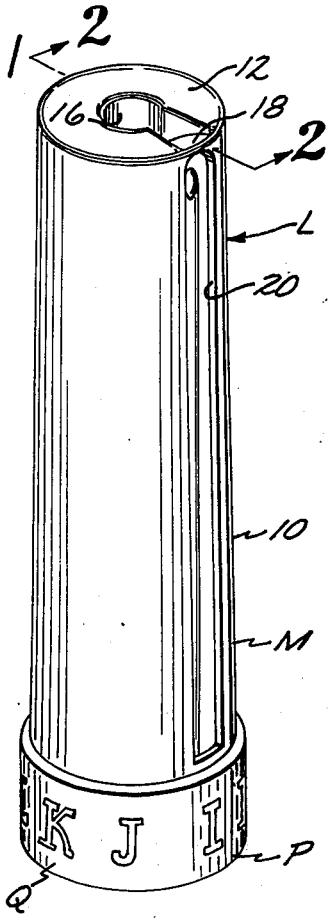
FIG. 1 is a perspective view of the device which may be used to store a number of crochet hook defining needles, and selectively dispensing any one of the needles therefrom.

The invention L as may best be seen in the drawings includes a cylindrical housing M in which a needle holding and needle dispensing assembly N is movably supported. The assembly N has a cap P rigidly secured thereto and the cap having a number of indicia Q imprinted thereon. When one of the indicia Q is transversely aligned with a longitudinal slot 20 in the housing, the indicia indicates which of the needles situated in the housing may be dispensed therefrom by causing the invention to move from a first to a second position. The needles are visually indicated in FIGS. 4 and 5 and identified by the letters E, F, G, H, I, J, K, O and OO that are used in trade to identify them as to size. The needles are generically identified in FIGS. 2 and 3 by the letter R rather than the specific letters previously mentioned.

Figure 2:
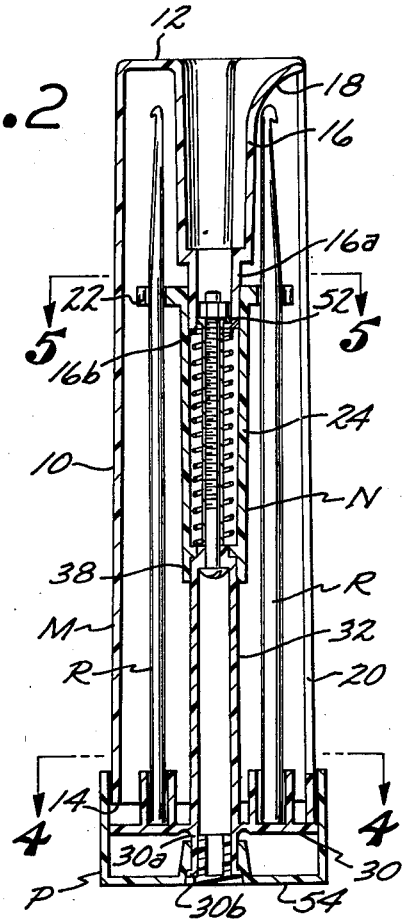
FIG. 2 is a longitudinal cross sectional view of the device taken on the line 2—2 of FIG. 1, with the device being in a first needle storing position.
Figure 3:
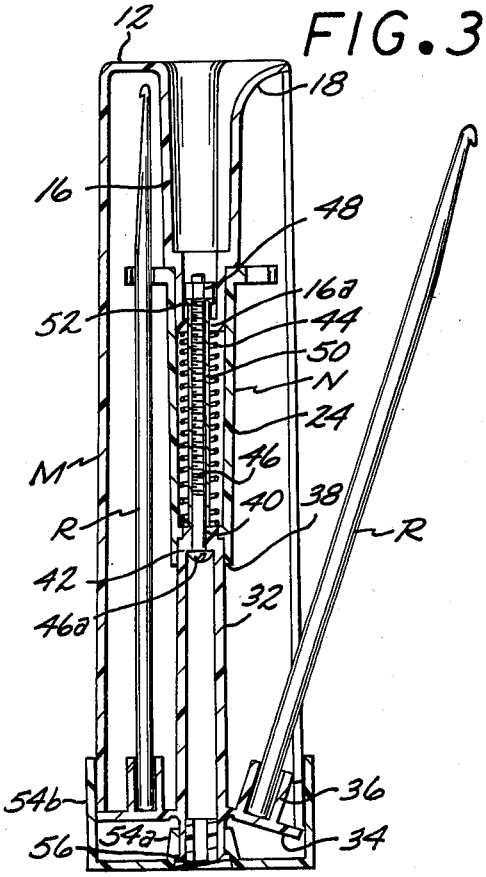
FIG. 3 is the same longitudinal cross sectional view as shown in FIG. 2, but with the device being disposed in a second position whereupon a needle is dispensed therefrom.

The housing M as can best be seen in FIGS. 1, 2 and 3, includes a cylindrical shell 10 that has a first end portion 12 and a second open end 14. The first end portion 12 includes an inwardly extending tubular member 16 that defines a longitudinal cam surface 18, and the tubular member including a portion **16*a* that is of circular transverse cross section. A longitudinal slot 20 is formed in the shell 10. The portion 16*a* as can best be seen in FIG. 2 includes a first body shoulder 16*b***.

Figure 4:
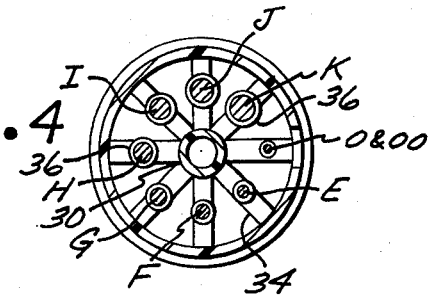
FIG. 4 is a transverse cross sectional view of the device taken on the line 4—4 of FIG. 2.
Figure 5:
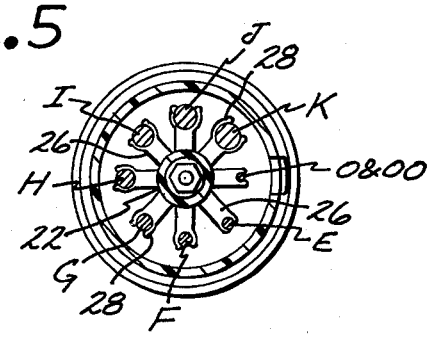
FIG. 5 is a second transverse cross sectional view of the device taken on the line 5—5 of FIG. 2.

The needle holding and needle dispensing assembly N includes a first generally circular member 22 that has a first tube 24 extending downwardly from substantially the center thereof as can be seen in FIG. 2. The member 22 is illustrated as including a number of circumferentially spaced radially extending legs 26 with each of the legs having a clip 28 on the outer end thereof. The clip 28 is of varying width in order that the clip may engage needles R of different transverse cross sections as shown in FIGS. 2, 4 and 5.

The assembly N also includes a second generally circular member 30 that has a tubular stub 38 projecting downwardly from the center thereof and this stub having an inwardly extending lip **30*b*. The second generally circular member 30 also has a second tube 32 extending upwardly therefrom as shown in FIG. 2. The second generally circular member 30 is illustrated as being defined by a number of circumferentially spaced radially extending second legs 34 which legs on the outer extremity thereof support tubular sockets 36. The sockets 36 are of various transverse cross sections to removably engage the ends of the needles R that are of different transverse cross sections. The first tube 24 has a first free end 38 shown in FIG. 2 that has a non-circular interior that slidably engages a first non-circular end 42 of the second tube 32. The first end 42 has a second shoulder 40** defined therein.

A compressed helical spring 44 is provided as shown in FIGS. 2 and 3 that is situated within the first tube 24 and is in abutting contact with the first shoulder **16*b* and second shoulder 40. An elongate screw 46 extends through openings in the first and second shoulder 16*b* and 40, with the screw including a head 46*a* that is in abutting contact with the second shoulder 40. The upper end of the screw is engaged by a nut 48 that is in abutting contact with the first body shoulder 16*b* when the invention is in the first position illustrated in FIG. 2. The screw 46 extends through a tubular spacer 50, which spacer has a flanged end 52 that is situated above the first body shoulder 16*b* and in abutting contact therewith. The cap P as may best be seen in FIGS. 2 and 3 includes a circular plate 54 that has a hub 54*a* extending upwardly therefrom, which hub has an internal circumferentially extending recess therein that is engaged by the lip 30*b*. The plate 54 has a cylindrical side wall 54*b* extending upwardly from the peripheral edge therof, and the side wall extending upwardly over the lower portion of the shell 10. A retainer 56 extends upwardly into the tubular stub 38 and forces the lip 30*b* of the stub into engagement with the hub 54*a* whereby the cap P is removably but nonrotatably supported on the stub 30*a*. The cylindrical side wall 54*b* has the indicia Q marked thereon, with each indicia being so related to one of the needles R supported on the assembly N, that when that particular indicia is longitudinally aligned with the slot 20, the indicia will indicate which one of the needles R is in a position to be pivoted outwardly through the slot 20. After the invention L has had the needles R disposed therein, the needles may be selectively dispensed therefrom by aligning the appropriate one of the indicia Q with the slot 20. The cap P is now moved upwardly relative to the housing, with the upper end of the needle R that is aligned with the slot 20 being forced into pressure contact to pivot the upper end of the needle outwardly through the slot to the position shown in FIG. 3. Due to the resiliency of the material defining the second legs 34, the needle while still disposed in one of the sockets 36** is easily lifted therefrom.

The use and operation of the invention has been described previously in detail and need not be repeated.

I claim:

1. A device for use in storing a plurality of needles of various sizes and selectively dispensing a desired one of said needles, said needles having first ends on which crochet hooks of different sizes are defined and second ends of different transverse cross sections, said needles being of substantially the same lengths, said device including:

a. a cylindrical housing that includes a first end portion and a second open end, said first end portion including an inwardly extending tubular member that defines both a longitudinally extending cam surface and a portion of circular transverse cross section which cam surface is radially aligned with a longitudinal slot in said housing, with said tubular member having a first inwardly extending body shoulder therein;

b. a needle-holding assembly that includes first and second generally circular members and tubular means having a second body shoulder intermediately disposed therein, with said first generally circular member including a plurality of circumferentially spaced resilient clips that removably engage longitudinal sections of said needles adjacent said first ends thereof and said second generally circular member including a plurality of circumferentially spaced sockets that are in longitudinal alignment with said clips and removably engage said second ends of said needles, with said assembly being disposed within said housing and said tubular means rotatably and slidably engaging said portion of said tubular member of circular transverse cross section;

c. compressed spring means that at all times tend to move said assembly away from said tubular member;

d. stop means that extend between said first and second body shoulders and allow said spring means to move said assembly and needles to a first position in said housing where said assembly may be rotated without said needles removably supported therein contacting said cam surface;

e. a cap that closes said second end of said housing and is rigidly secured to said tubular means; and f. a plurality of indicia on said cap that visually indicates the size of a particular one of said needles that is aligned with said slot, and with said aligned needle being pivoted outwardly therethrough when said assembly and cap are manually forced towards said first end of said housing from a first position towards a second position where said needle is aligned with said slot and forced into sliding pressure contact with said cam surface, with said spring means automatically returning said assembly to said first position when said cap and assembly no longer have said manual force exerted thereon.

2. A device as defined in claim 1 wherein said second generally circular member includes a plurality of circumferentially spaced, radially extending resilient legs, with each of said legs supporting one of said sockets on an outer end thereof.

3. A device as defined in claim 1 wherein said cap includes a cylindrical side wall that extends upwardly over said cylindrical shell, with said indicia being defined on said cylindrical side wall.

4. A device as defined in claim 1 wherein said compressed spring means is a helical spring longitudinally disposed in said tubular means and in abutting contact with said first and second body shoulders.

5. A device as defined in claim 4 wherein said tubular means are first and second tubes that extend towards one another from said first and second generally circular members, which first and second tubes have free non-circular end portions that slidably engage one another, with said second tube having said second body shoulder defined therein.

6. A device as defined in claim 5 wherein said stop means is a screw having head and a nut that engages said screw, with said screw extending longitudinally through aligned openings defined by said first and second body shoulders, which nut is in abutting contact with said first body shoulder, and said head is in abutting contact with said second body shoulder when said assembly is in said first position.

* * * * *